United States Patent [19]

Stewart

[11] 4,100,740

[45] Jul. 18, 1978

[54] REFUSE VEHICLE HYDRAULIC SUPPLY SYSTEM

[75] Inventor: Melvin E. Stewart, Rapidan, Va.

[73] Assignee: City Tank Corporation, Culpeper, Va.

[21] Appl. No.: 799,648

[22] Filed: May 23, 1977

[51] Int. Cl.[2] ..... F15B 15/18

[52] U.S. Cl. ..... 60/431; 60/433; 60/DIG. 2; 214/83.3

[58] Field of Search ..... 60/423, 431, 433, 468, 60/DIG. 2; 214/83.3

[56] References Cited

U.S. PATENT DOCUMENTS

| | | | |
|---|---|---|---|
| 2,516,662 | 7/1950 | Vickers et al. | 60/431 X |
| 2,746,240 | 5/1956 | Brown et al. | 60/431 |
| 3,812,676 | 5/1974 | Smith | 60/431 |

*Primary Examiner*—Edgar W. Geoghegan

*Attorney, Agent, or Firm*—Mason, Fenwick & Lawrence

[57] ABSTRACT

A hydraulic fluid supply system for providing pressurized fluid to fluid actuated components on a refuse collection vehicle, generally including a fluid tank, a pump operatively connected to the crankshaft of the refuse vehicle engine for continuous operation and having an inlet communicating with the tank, a diversion valve having an inlet communicating with the outlet of the pump and having an outlet selectively communicating with the tank and the fluid actuated components on the refuse collection vehicle, means for increasing the idle speed of the engine to a predetermined actuation idle speed when the diversion valve outlet is communicating with the fluid actuated components, and means for preventing the engine from exceeding a predetermined override speed when the outlet of the diversion valve is communicating with the fluid actuated components thereby preventing damage to the pump if an operator accidentally depresses the accelerator pedal in the vehicle.

17 Claims, 4 Drawing Figures

REFUSE VEHICLE HYDRAULIC SUPPLY SYSTEM

This invention relates to a fluid supply system and more particularly to a hydraulic fluid supply system for providing pressurized fluid to fluid actuated components on a refuse collection vehicle. The invention further contemplates such a fluid supply system in which the pump is permitted to operate continuously during operation of the refuse collection vehicle engine.

In the prior art, there has been developed hydraulic fluid supply systems for refuse collection vehicles which generally include a fluid tank, a hydraulic pump connected to a power takeoff from the transmission of the refuse vehicle engine, a clutch to disengage the pump for high speed travel of the vehicle between the loading stops and travel to and from a dump site, and means for increasing the idle speed of the refuse vehicle engine to prevent stalling out of the engine when the fluid actuated components on the vehicle are operated.

These previously known refuse vehicle hydraulic supply systems have required the installation of clutches in order to prevent damage to the pump and hydraulic system caused by excessive pressures which would occur if the pumps were permitted to operate while the vehicle is driven down the highway. Additionally, these previously known systems have been operated through transmission mounted power takeoffs to permit operation of the pumps at rotational speeds which are lower than the speed of the engine crankshaft. This feature results in reduction in rotational speed through the power takeoffs by 55% to 90% while incurring the resultant efficiency losses inherent within transmission power takeoffs. If these previously known hydraulic systems were to operate during those times when the vehicle is travelling at high speed, severe damage would result from overheating of the hydraulic fluid and excessive hydraulic fluid pressure in the pump and associated fluid actuated components.

Accordingly, it is the principal object of the present invention to provide a novel hydraulic supply system for the fluid actuated components of a refuse collection vehicle.

Another object of the present invention is to provide a novel hydraulic supply system for the fluid actuated components of a refuse collection vehicle which eliminates transmission mounted power takeoff pumps and the inefficiency which results from such a configuration.

A further object of the present invention is to provide a hydraulic supply system for operating the fluid actuated components of a refuse collection vehicle wherein the system does not require a clutch to disengage the pump during high speed operation of the vehicle and permits the pump to operate at full engine speed without causing excessive heating of the hydraulic fluid or damage to the pump and associated system components.

A further object of the present invention is to provide an efficient hydraulic supply system for the packing components on a refuse collection vehicle which permit the vehicle engine to operate at lower speeds to conserve fuel, reduce engine wear and decrease noise.

A still further object of the present invention is to provide a hydraulic supply system in which the pump output is directed to a reservoir tank to minimize the heating of the hydraulic supply fluid when high engine speed is required for transporting the vehicle over the road between loading stops and travel to and from dump sites.

Other objects and advantages of the present invention will become apparent to those persons having ordinary skill in the art to which the present invention pertains, from the following description taken in conjunction with the accompanying drawings wherein.

Figures 1, 2:
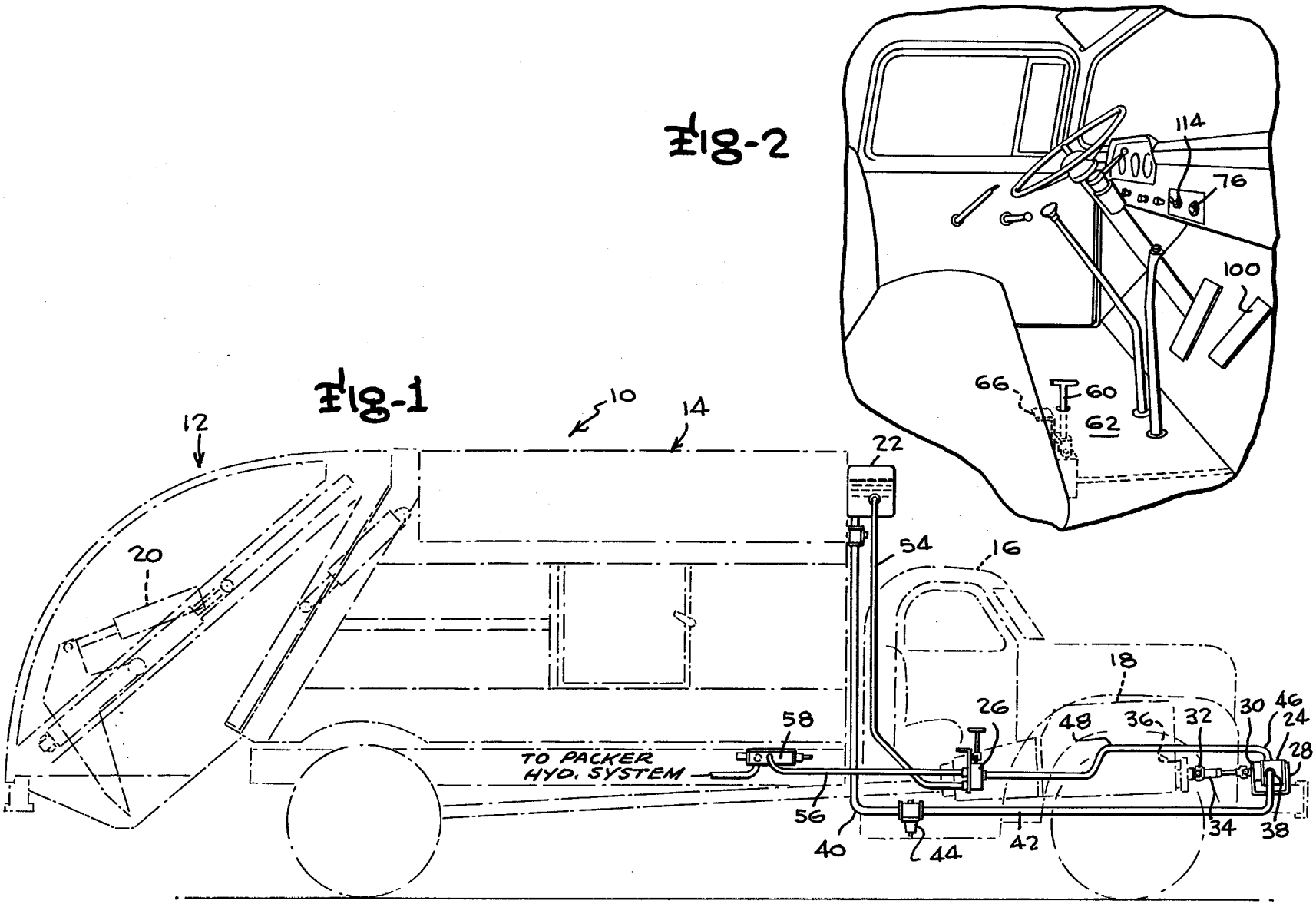
FIG. 1 is a side elevational view of a refuse collection vehicle on which there is mounted an embodiment of the present invention.
FIG. 2 is a perspective fragmentary view of the operator's cab on the refuse collection vehicle shown in FIG. 1 illustrating the various manual control components in an embodiment of the present invention.
Figure 3:
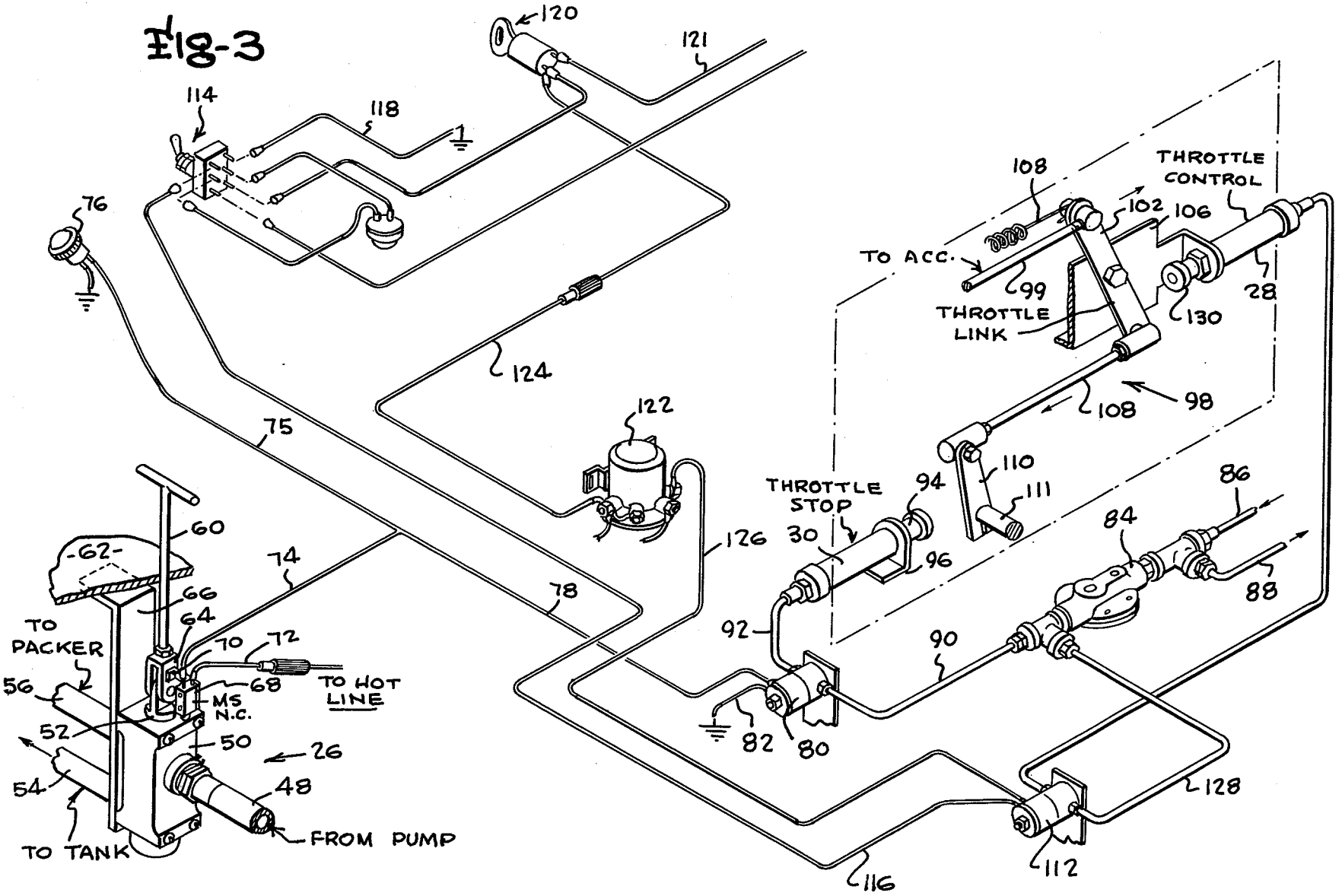
FIG. 3 is a perspective schematic-diagrammatic view of a control portion of an embodiment of the present invention for use on a refuse collection vehicle having a diesel engine.

Referring to FIGS. 1, 2 and 3, there is illustrated a refuse collection vehicle 10 including a refuse receiving hopper 12 mounted on the rear end of a refuse storage body 14 rigidly secured on a truck chassis having an operator's cab 16 and a diesel or gasoline engine 18, a fluid actuated packer cylinder 20 which is actuated for transferring refuse from the receiving hopper into the storage body and compacting the refuse therein, and the hydraulic fluid supply system of the present invention having a hydraulic fluid reservoir tank 22, a hydraulic pump 24 driven directly from the crankshaft of the engine 18, a diversion valve 26, a pneumatically actuated throttle control cylinder 28 and a pneumatically actuated throttle stop cylinder 30.

The truck chassis, storage body and packing mechanism may be of any conventional construction requiring a supply of pressurized hydraulic fluid for the actuation of fluid actuated components as required to supply power for the transferring and compaction of refuse. Referring to FIG. 1, the hydraulic pump 24, which is of conventional configuration, is mounted directly to the front bumper and front bumper support members by a rigid support bracket 28. An input shaft 30 of the pump 24 is connected by two universal joints 32 on opposite ends of an adjustable length drive shaft 34 to the forward end of the drive shaft 36 of the vehicle engine 18 which causes the pump 24 to rotate at the same speed as the crankshaft of the engine and to be continuously operated at any time the engine 18 is operating. Hydraulic fluid flows into the pump 24 through a pump inlet 38 from the reservoir tank 22 by way of fluid lines 40 and 42 which communicate the tank 22 with the pump 24. A filter 44 of conventional construction connects fluid lines 40 and 42 to provide continuous filtering of the hydraulic fluid. The outlet 46 from the pump 24 is connected to the inlet of the diversion valve 26 by a fluid line 48.

The diversion valve 26, as best shown in FIG. 3, includes a conventional two-position valve body 50 having a valve spool 52 slidable therein between a first position in which the fluid line 48 is communicated with a return fluid line 54 communicating an outlet of the diversion valve 26 with the reservoir tank 22 and a second position in which the fluid line 48 from the pump 24 is communicated with a packer fluid line 56. Pressurized hydraulic fluid is supplied to the fluid actuated components such as the packer cylinder 20, shown in FIG. 1, through a main packer valve 58 in packer fluid line 56 with control of the hydraulic fluid and sequencing of the fluid actuated components being controlled in a conventional manner.

Movement of the spool body 52 is achieved through manually grasping a handle 60 which extends through the floor 62 in the cab of the refuse vehicle as shown in FIG. 2. The handle is attached to the spool 52 by a clevis 64 which is mounted to an upper free end of the spool 52 as shown in FIG. 3. The valve body 50 is mounted to the cab floor 62 of the refuse vehicle by a support bracket 66 as shown in FIGS. 2 and 3. A normally closed microswitch 68 is mounted on the valve body 50, as shown in FIG. 3, and is opened by actuation plate 70 mounted to the side of clevis 64. The actuation plate causes the microswitch to open when the handle 60 is pushed downwardly to the first position in which the hydraulic pump is communicated with the tank 22 through fluid line 54.

When the handle 60 is pulled upwardly by the operator who is sitting in the cab 16, the voltage on the supply line 72 passes through the closed contacts of the microswitch 68 to energize line 74. An operating lamp 76, positioned on the dashboard of the cab adjacent the conventional controls as shown in FIG. 2, is lighted by the voltage on line 75 and indicates that the diversion valve has been moved to the position in which the pump 24 is communicated with the fluid actuated components of the packer mechanism through fluid line 56.

Simultaneously, lead line 78 which is connected to the coil of a throttle stop air solenoid 80 is energized by current passing from line 78 to ground lead 82 which activates the air solenoid to permit air to pass therethrough from pressure protection valve 84 which is of conventional configuration and receives pressurized air through inlet line 86 with air returnable through outlet line 88. Air therefore passes from air line 90 through the air solenoid 80 and an inlet air line 92 which communicates with the throttle stop cylinder 30 to cause a throttle stop piston 94 to be extended. The air cylinder 30 is mounted to the engine by a support bracket 96 and piston 94 has an adjusting feature of conventional configuration to control the length of travel of the piston 94 thereby attaining a desired stop position for throttle linkage 98.

The throttle control installation shown in FIG. 3 is applicable to a diesel engine having a full range or mechanically variable governor thereby automatically controlling the speed of the engine in direct relationship to the position of the throttle control linkage. The throttle linkage 98 includes an accelerator link 99 which is operatively connected to the accelerator pedal 100, shown in FIG. 2, at one end and is pivotally connected at the other end to a throttle link 102 pivotally mounted centrally thereof to a support bracket 106 attached to the engine. A biasing spring 108 returns the accelerator link 98 to the idle position when the operator lifts his foot from the pedal 100. Attached to the second end of the throttle link 102 is a control link 108 which controls the fuel injection pump and supply of air to the diesel engine in a conventional manner through control link 110 pivotally attached to the second end thereof. Control link 110 is pivotal about pivot pin 111 mounted on the engine.

The throttle stop piston 94 prevents the control link 108 from being moved beyond a predetermined distance by engagement with the pivotal control link 110 if the operator in the cab 16 accidentally attempts to depress the accelerator pedal 100 which would cause the vehicle engine 18 to over speed beyond a predetermined override speed. Excessive speed could cause damage to the pump 26 through excessive pressure or heat within the system.

Actuation of the throttle control cylinder 28 is achieved through energizing a throttle control air solenoid 112 when a throttle control switch 114 mounted on the dashboard adjacent the signal lamp 76 is moved to the packer position connecting the ground lead 116 from the air solenoid 112 to a ground lead 118. Voltage is applied to the air solenoid 112 when the ignition switch 120 is turned to the on position as required to operate the engine of the vehicle. In this position, the ignition switch applies voltage through accessory relay 122 via power lead 124 to lead 126 which connects the relay with the air solenoid 112. The throttle control air solenoid 112 operates in the same manner as the throttle stop air solenoid 80 and receives pressurized air through inlet line 128 to supply pressurized air to the throttle control air cylinder 28 when the packer switch 114 is closed on the dash panel of the refuse vehicle cab.

The throttle control air cylinder 28 causes a piston 130 to extend a predetermined distance to engage the throttle line 102 and cause it to rotate through a predetermined angle. This movement of the throttle link 102 in combination with the engine governor increases the speed of the engine to a predetermined actuation idle speed of approximately 1750 revolutions per minute to prevent stalling out of the engine due to the additional load created by the pump 24 supplying the packer mechanism. The air cylinder 28 is mounted to the engine block by support bracket 106 and is similar in construction to the throttle stop air cylinder 30.

Figure 4:
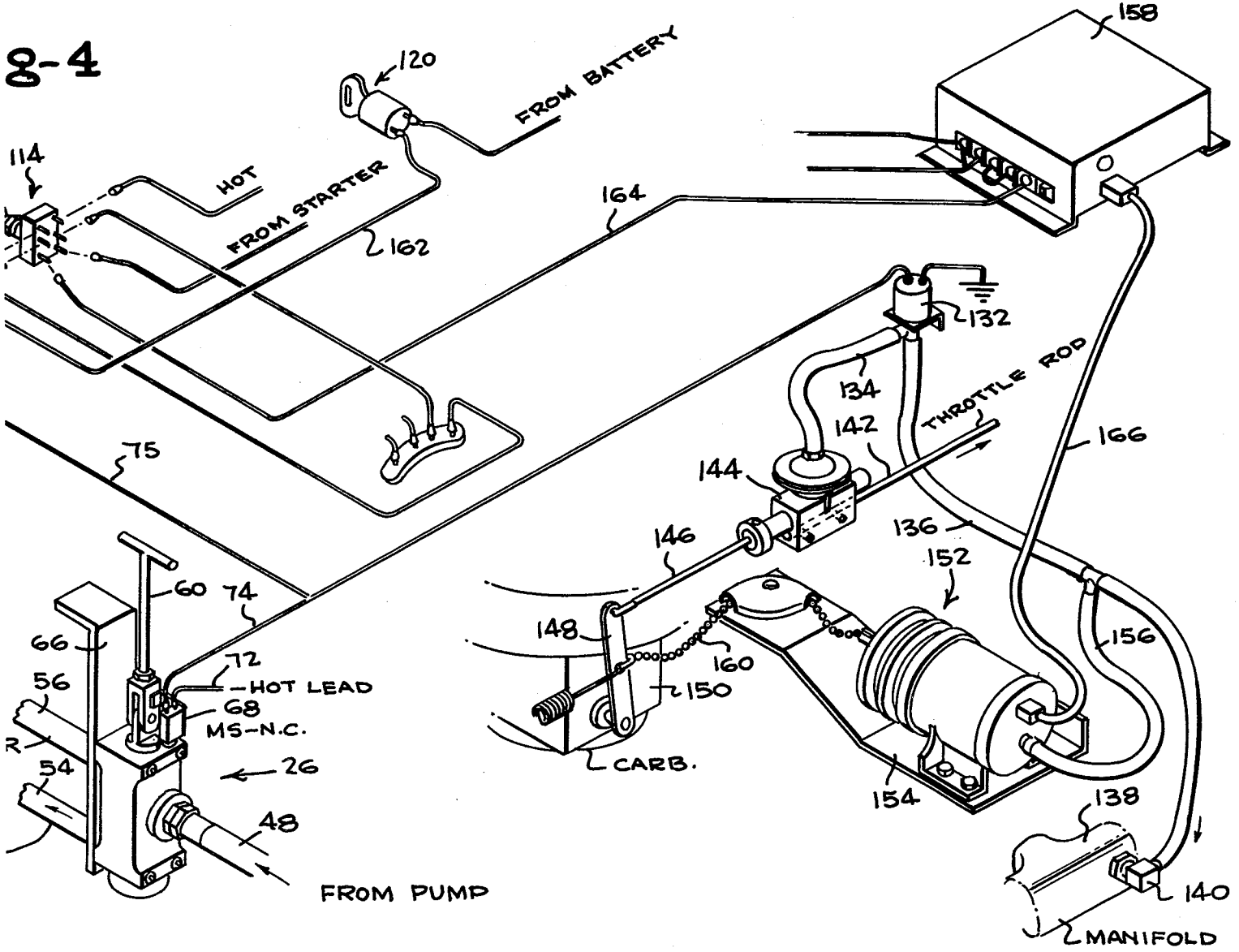
FIG. 4 is a perspective schematic-diagrammatic view of a control portion of an alternative embodiment of the present invention for use on a refuse collection vehicle having a gasoline engine.

Referring now to the installation shown in FIG. 4, there is shown an application of the present invention to a gasoline engine which requires the installation of a conventional governor control to achieve the desired results. This installation includes the packer valve 26, the operator lamp 76, the control switch 114 and the ignition switch 120.

When the microswitch 68 is actuated through movement of the handle 60 by the operator, voltage is applied to the operating lamp 76 and to an air solenoid 132 which communicates a throttle vacuum line 134 with a manifold vacuum line 136 communicating directly with the engine manifold 138 through fitting 140. Throttle control is provided by a throttle rod 142 which is operatively connected to the accelerator pedal 100 in the operator's cab as shown in FIG. 2.

A conventional throttle-disconnect 144, governor 152 and control box 158, such as Model 5657-3 manufactured by the Generac Company of Waukesha, Wisconsin, are utilized with the gasoline engine to prevent overspeeding of the engine and to increase the engine speed to a predetermined actuation idle speed during operation of the packer mechanism. The foot-throttle disconnect 144 provides a fixed connection between the throttle rod 142 and the accelerator link 146 except when activated by air solenoid 132 which causes disengagement of a locking pin between the throttle rod and accelerator link and permits the accelerator pedal 100 in the cab to be depressed without moving the accelerator linkage 146, crank 148 and the butterfly valve in the carburetor 150. The governor 152 is mounted on the engine on a support plate 154 and receives its power from the application of the manifold vacuum through vacuum line 156. Movement of the governor is controlled by a control box 158 which causes the governor 152 to move a flexible chain 160 attached to the crank 148 on the butterfly valve of the carburetor 150. This movement is utilized to position the butterfly valve in a position to maintain the desired speed of the refuse vehicle engine in response to the actuation of the control switch 114 on the dash panel. Switch 114 causes voltage from the ignition switch 120 to be supplied through lead 162 to the control package 158 via power input lead 164. The control package 158 communicates with the governor 152 via control cable 166.

Operation of the embodiment of the present invention shown in FIG. 3 is simply initiated by turning the key in the ignition switch 120 to start the vehicle engine. With the handle 60 on the diversion valve 26 pushed down to place the valve spool 52 in the first position, the hydraulic fluid from tank 22 will be pumped through inlet lines 40 and 42 and back to the tank by the pump 24 which is continuously operating as the engine crankshaft rotates. The operator moves the packer switch 114 to the operating position which causes the throttle control piston 130 to extend and increase the speed of the engine to a predetermined actuation idle speed which prevents stalling of the engine when the fluid actuated components in the truck such as the packer cylinder 20 are actuated. The operator then reaches down toward the floorboard and pulls the handle 60 upwardly to the second position which causes the pressurized hydraulic fluid from the pump 24 to flow through the packer line 56 and the packer valve 58 to be distributed in the conventional manner to the actuation mechanisms. Before the operator drives the vehicle to another loading site or the dump, he returns the handle 60 by pressing it downwardly to move the spool 52 to its first position thereby causing the pressurized hydraulic fluid from the pump to be circulated back through the reservoir tank 22. The operator returns the packer switch 114 to the drive position which causes the throttle control piston 130 to retract and decrease the idle speed of the engine.

It can be clearly seen that the gasoline engine control system shown in FIG. 4 operates in essentially the same manner as that just described for the diesel engine. The switch 114 causes the control box 158 to increase the speed of the engine via the governor 152 which causes chain 160 to move crank link 148 and open the butterfly valve in the carburetor to increase the idle speed of the engine to the predetermined actuation idle speed thereby preventing stalling of the engine. The movement of the handle 60 by the operator activates microswitch 68 which causes solenoid 132 to communicate throttle vacuum line 134 with manifold line 136 thereby causing throttle linkage 142 to be disengaged from the accelerator linkage 146 to prevent the operator from depressing the accelerator pedal 100 and causing damage to the pump 24 through over speed of the engine.

From the foregoing detailed description, it will be evident that a number of changes, adaptations and modifications of the present invention will come within the province of those skilled in the art. However, it is intended that all such variations not departing from the spirit of the invention be considered as within the scope thereof as limited solely by the appended claims.

I claim

1. A hydraulic fluid supply system for providing pressurized fluid to fluid actuated components on a refuse collection vehicle, said system comprising a fluid tank, a pump operatively connected to the crankshaft of the refuse vehicle engine for continuous operation, said pump having an inlet communicating with said tank, diversion means having an inlet communicating with the outlet of said pump and having an outlet selectively communicable with said tank and said fluid actuated components on said refuse collection vehicle, and means for increasing the idle speed of the engine to a predetermined actuation idle speed when the diversion means outlet is communicating with said fluid actuated components.

2. The hydraulic fluid supply system of claim 1 additionally including a means for preventing the engine from exceeding a predetermined override speed when the outlet of the diversion means is communicating with said fluid actuated components thereby preventing damage to the pump if an operator accidentally depresses the accelerator pedal when the diversion means is communicating with the fluid actuated components.

3. The hydraulic supply system of claim 1 wherein said diversion means comprises a manually operable valve selectively movable between a first position which communicates the outlet of the valve with said tank and a second position which communicates the outlet of the valve with said fluid actuated components.

4. The hydraulic fluid supply system of claim 1 wherein said means for increasing the idle speed of the engine comprises a pneumatic actuator operably connected to the accelerator linkage of the refuse vehicle engine, said actuator selectively extendable for moving the accelerator linkage to increase the engine idle speed to the predetermined actuation idle speed when the outlet of the diversion means is communicating with the fluid actuated components.

5. The hydraulic fluid supply system of claim 1 wherein said pump is positioned in front of the refuse vehicle engine and additionally includes a drive shaft having one end thereof engaging the crankshaft of the engine and the other end thereof engaging an input shaft on said pump.

6. The hydraulic fluid supply system of claim 3 wherein the manually operable valve includes an actuation handle mounted interiorly of the refuse vehicle cab thereby permitting the vehicle operator to divert the pressurized fluid from the tank to the fluid actuated components.

7. The hydraulic fluid supply system of claim 6 wherein said means for increasing the idle speed of the engine comprises a pneumatic actuator operably connected to the accelerator linkage of the refuse vehicle engine, said actuator selectively extendable for moving the accelerator linkage and increasing the engine idle speed to the predetermined actuation idle speed when the outlet of the diversion means is communicating with the fluid actuated components.

8. The hydraulic fluid supply system of claim 2 wherein said means for increasing the idle speed of the engine comprises a pneumatic actuator operably connected to the accelerator linkage of the refuse vehicle engine, said actuator selectively extendable for moving the accelerator linkage and increasing the engine idle speed to the predetermined actuation idle speed when the outlet of the diversion means is communicating with the fluid actuated components.

9. The hydraulic fluid supply system of claim 3 wherein said means for increasing the idle speed of the engine comprises a pneumatic actuator operably connected to the accelerator linkage of the refuse vehicle engine, said actuator selectively extendable for moving the accelerator linkage and increasing the engine idle speed to the predetermined actuation idle speed when the outlet of the diversion means is communicating with the fluid actuated components.

10. The hydraulic fluid supply system of claim 4 wherein said pump is positioned in front of the refuse vehicle engine and additionally includes a drive shaft having one end thereof engaging the crankshaft of the engine and the other end thereof engaging an input shaft on said pump.

11. The hydraulic fluid supply system of claim 4 additionally including a switch means for simultaneously activating said pneumatic actuator when said valve is moved to said second position.

12. The hydraulic fluid supply system of claim 11 wherein the manually operable valve includes an actuation handle mounted interiorly of the refuse vehicle cab thereby permitting the vehicle operator to divert the pressurized fluid from the tank to the fluid actuated components.

13. The hydraulic fluid supply system of claim 5 wherein the manually operable valve includes an actuation handle mounted interiorly of the refuse vehicle cab thereby permitting the vehicle operator to divert the pressurized fluid from the tank to the fluid actuated components.

14. The hydraulic fluid supply system of claim 2 additionally including a switch means for simultaneously activating the pneumatic actuator when said valve is moved to said second position.

15. The hydraulic fluid supply system of claim 2 wherein said diversion means comprises a manually operable valve selectively movable between a first position which communicates the outlet of the valve with said tank and a second position which communicates the outlet of the valve with said fluid actuated components.

16. The hydraulic fluid supply system of claim 2 wherein said pump is positioned in front of the refuse vehicle engine and additionally includes a drive shaft having one end thereof engaging the crankshaft of the engine and the other end thereof engaging an input shaft on said pump.

17. The hydraulic fluid supply system of claim 15 additionally including an actuation switch means for simultaneously activating said pneumatically operated actuator when said valve is moved to said second position.

* * * * *